United States Patent [19]

Pike

[11] 4,188,692

[45] Feb. 19, 1980

[54] AIR JET FOR YARN ENTANGLEMENT

[75] Inventor: Herbert J. Pike, Martinsville, N.J.

[73] Assignee: J. P. Stevens & Co., Inc., New York, N.Y.

[21] Appl. No.: 23,564

[22] Filed: Mar. 26, 1979

[51] Int. Cl.[2] ..... D02G 1/16

[52] U.S. Cl. ..... 28/271

[58] Field of Search ..... 28/271, 274

[56] References Cited

U.S. PATENT DOCUMENTS

| | | | |
|---|---|---|---|
| 3,473,315 | 10/1969 | LaNoir | 28/271 X |
| 3,845,528 | 11/1974 | Vermeer et al. | 28/271 |
| 3,978,558 | 9/1976 | Pike | 28/274 |
| 3,983,609 | 10/1976 | Pike | 28/274 |

FOREIGN PATENT DOCUMENTS

| | | | |
|---|---|---|---|
| 1172440 | 10/1958 | France | 28/274 |

*Primary Examiner*—Robert Mackey

*Attorney, Agent, or Firm*—Michael T. Frimer; Charles Stein

[57] ABSTRACT

Yarn is treated in air entanglement jet having a main passageway in which one or more multifilament yarns are entangled, a second passageway which intercepts the bottom of the main passageway at an acute angle and slants downward therefrom in the upstream direction and an air inlet which intercepts the bottom of the main passageway so that its axis intersects the axis of the main passageway at an angle of about 86°-88.5° with the point of intersection being not more than 0.20 inches from the downstream end of the main passageway. The air inlet duct slants downward from the main passageway in the downstream direction. A lip is provided which begins at or close to the bottom of the downstream end of the main passageway and extends in the downstream direction. A jet of air is introduced into the main passageway through the air inlet duct and strikes the upper wall thereof forming a plural vortex turbulent zone which entalges the yarns. During operation the yarn is fed into the air jet at a small degree of overfeed.

3 Claims, 3 Drawing Figures

FIG. 1
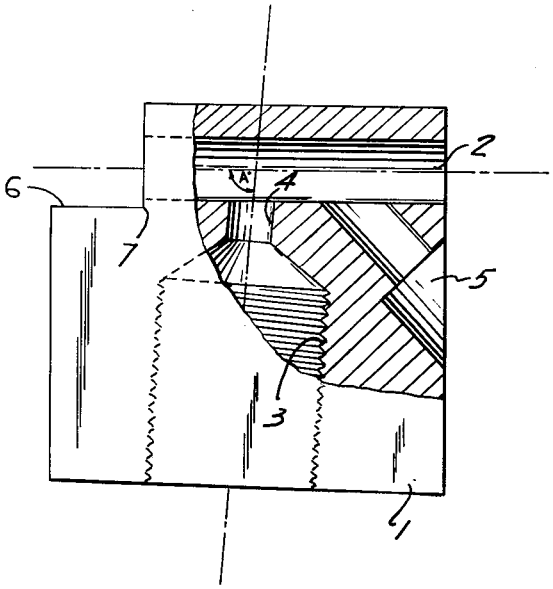
FIG. 2
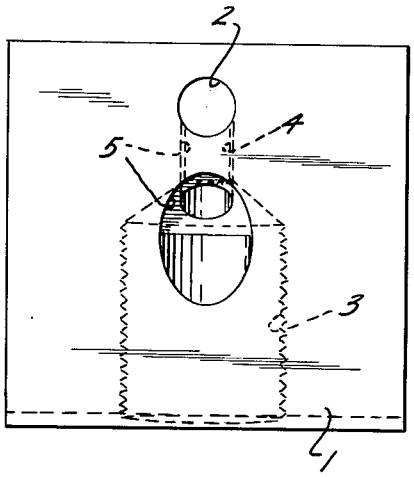
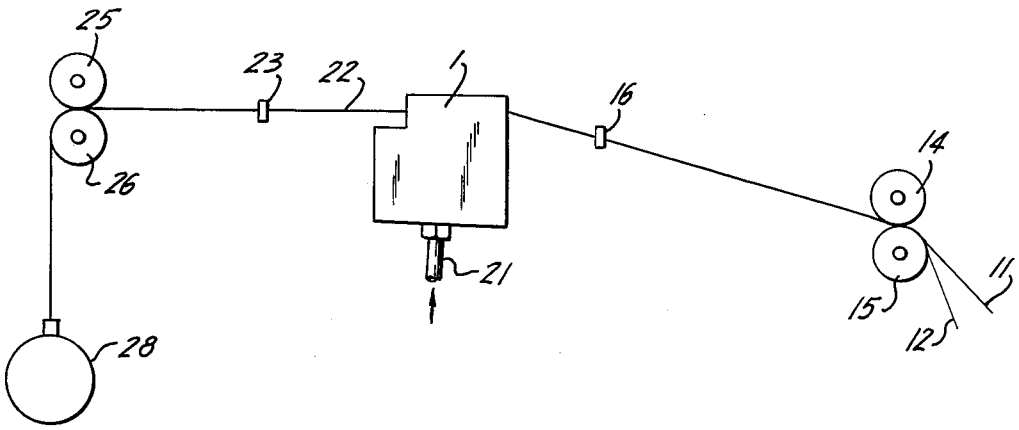
FIG. 3

AIR JET FOR YARN ENTANGLEMENT

BACKGROUND OF THE INVENTION

1. Field of the Invention

This invention relates to an air jet for the production of entangled multifilament yarn.

2. Prior Art

It is known to entangle multifilament yarns by means of an air jet apparatus in which air is introduced into a chamber at an angle to the travel of yarn to form a plural vortex turbulent air zone that entangles or interlaces filaments of the yarn. One such apparatus is disclosed in my U.S. Pat. No. 3,983,609, issued Oct. 5, 1976, which relates to an air entangling apparatus wherein the air jet is in the form of a block and in which an air stream enters a central bore at substantially right angles thereto. The bore extends all the way through the block and preferably has a uniform cross section so that air leaves at both ends of the bore. The incoming air jet strikes the upper wall of the central bore at a point opposite to the point of air introduction and splits to form two vortices in the upper portion of the central bore. Yarn introduction into the central bore is upstream from the air jet and is at an angle so that the yarn moves to the top of the turbulent air stream in the area of formation of the air vortices, where it oscillates back and forth across the stream. The yarn moves for a short distance countercurrent to the air leaving the upstream end of the central bore and then cocurrent with the air stream leaving the other end of the bore. The angled introduction of the yarn and the countercurrent air flow urge the yarn toward the top of the bore and hold the yarn in the upper portion of the bore in the area of formation of the air vortices.

When the apparatus of U.S. Pat. No. 3,983,609 is used to combine two or more multifilament yarns a product is obtained which is useful for many purposes. However, there are some end uses which require combined yarns having a tighter, more compact filament entanglement. In particular, problems have been encountered with some looms, such as Sulzer looms, which form a shed by separating the warp yarns with a series of very closely spaced fingers that catch on any loops protruding from the surface of the yarn.

SUMMARY OF THE INVENTION

The present invention is directed to an air jet apparatus which produces a combined entangled yarn having a tighter, more compact entanglement than the product obtained with the air jet apparatus of U.S. Pat. No. 3,983,609. This improved entanglement is accomplished by means of changes in the structure of the air jet of the above patent.

The apparatus of this invention has an air jet which comprises a block having a main passageway extending therethrough from the upstream side to the downstream side. A second passageway intercepts the bottom of the main passageway at an acute angle and slants downward therefrom in the upstream direction. An air inlet duct intercepts the bottom of the main passageway downstream from the second passageway. The axis of the air inlet duct and the axis of the main passageway are substantially in the same plane and intersect at an angle of about 86°-88.5°, with the point of intersection being not more than 0.20 inch (preferably 0.14 to 0.19 inch) from the downstream end of the main passageway. The air inlet duct slants downward from the main passageway in the downstream direction. A lip, which begins at or close to the bottom of the downstream end of the main passageway, extends in the downstream direction, preferably for a distance of about 0.18 to 0.32 inch. Preferably, the lip is not more than about 0.10 inch below the bottom of the main passageway.

In the description and claims, the side of the main passageway intercepted by the air inlet duct has been designated as the bottom of the main passageway in order to describe the relative positions of the elements of the jet. It is to be understood however, that the entire jet structure can be oriented in different positions.

There are three main differences between the air jet structure of this invention and the air jet of U.S. Pat. No. 3,983,609, which in combination are responsible for the tighter, more compact entanglement of the product of this invention. First, in the present invention the air inlet duct slants downward from the main passageway in the downstream direction so that the axis of the air inlet duct and the axis of the main passageway intersect at an angle of 86°-88.5° rather than at right angles. As a result, the airstream entering the main passageway is angled slightly upstream. An angle of at least 1.5° is necessary to significantly increase the compactness of the entanglement while above about 4° the upstream force of the airstream begins to interfere with the proper feeding of the yarn through the air jet. Second, in the jet of the present invention the distance from the downstream end of the main passageway to the intersection of the axis of the main passageway with the axis of the air inlet duct should not exceed 0.20 inch. Extending the main passageway beyond this limit decreases the compactness of the filament entanglement. The third feature contributing to a tighter, more compact entanglement is the presence of a lip which extends downstream from the exit end of the main passageway.

Means are provided for feeding one or more multifilament yarns through the main passageway with a small degree of overfeed, preferably about 0.1 to 10%. This small amount of overfeed provides sufficient slack to permit the filaments to entangle, but not so much overfed yarn as to interfere with the formation of a tight, compact product which does not have any loops extending from its surface. The yarns are either fed directly into the upstream end of the main passageway or are fed into the second passageway which leads the yarns upward into the main passageway. The yarns can be fed through the air jet at very high speeds with yarn outputs in the range of 125 yds./minute up to about 1250 yds./minute having been obtained.

The air pressures are usually maintained within the range of about 10 to 100 p.s.i.g. In general, at the higher yarn speeds, higher air pressures are required. The incoming airstream from the air inlet strikes the upper wall of the main passageway and splits to form two vortices in the upper portion of the main passageway which rotate in opposite directions. It is in the area of these vortices that most of the entanglement occurs. As described above, the air inlet duct is constructed so that the airstream is angled slightly upstream as it enters the main passageway.

The second passageway is angled in the opposite direction so that of the air inlet duct and intercepts the main passageway at an angle which is preferably in the range of about 30° to 65°, with best results being obtained at or near 45°. When the yarn is fed through the second passageway, the angle of introduction into the main passageway directs the yarn to the top of the main passageway in the area of formation of the air vortices. The yarn oscillates from side to side in the upper portion of the main passageway from one air vortice to the other. It is also possible to feed the yarn directly into the main passageway. In such operation, a guide should be used which directs the yarn upward into the main passageway such as an upstream guide slightly below the entrance to the main passageway. Preferably, this guide should direct the yarn upward into the main passageway at an angle of about 10°. The use of such a guide system in combination with the air currents resulting from the intercepting passageways is generally sufficent to hold the yarn in the upper portion of the main passageway in the area of the air vortices and gives satisfactory entanglement. In addition to an upstream guide, it is preferable to have a guide downstream from the lip of the air jet which prevents the yarn from moving downward over the edge of the lip.

While not critical, the diameter of the air inlet duct should generally be from about ⅛ inch to 1/32 inch in diameter. The optimum size varies somewhat with the air pressure, rate of yarn feed, diameter of the yarns and the number of yarns.

The surfaces of the air jet which are contacted by the yarns during the entanglement operation are preferably made of a hard, durable material such as hardened steel, ceramic or hard coated anodized aluminum to minimize wear. When ceramic is used, the texture of the surface of this material gives additional improvement in the compactness of the yarn entanglement.

The apparatus of the present invention can be used to entangle pretextured yarns as well as yarns which have not been textured. While a single multifilament yarn can be treated, preferred products are prepared by using the present invention to combine two or more multifilament yarns. The yarns need not be the same and can vary in color, dyeability or other characteristics so that a variety of visual effects and physical property combinations can be obtained. When pretextured yarns are employed, the yarns can be fed directly from texturing devices such as friction disc false twisters into the air jet of the present invention.

BRIEF DESCRIPTION OF THE DRAWINGS

FIG. 1 is a vertical cross section, partially broken away, of the air jet of the invention taken parallel to the direction that the yarn is fed through the air jet.

FIG. 2 is a view taken at right angles to FIG. 1.

FIG. 3 is a diagram showing one means of feeding yarns through the air jet.

DESCRIPTION OF THE PREFERRED EMBODIMENT

Referring to FIGS. 1 and 2, an air jet is shown made from a block (1) with main passageway (2), angled second passageway (5), threaded air introduction duct (3), air inlet duct (4) and lip (6). The axis of air inlet duct (4) intersects the axis of main passageway (2) at an angle (A) which can range from about 86°-88.5°. The upstream end (7) of the lip (6) can be even with or up to 0.10 inch below the bottom of the downstream end of main passageway (2). One or more multifilament yarns are fed into the main passageway (2) from the upstream direction either directly or through passageway (5). Air is introduced into the main passageway (2) through air inlet duct (4) and strikes the curved upper wall of the main passageway to form two vortices which entangle the filaments of the yarn.

FIG. 3 illustrates a typical arrangement for feeding yarns through the air jet (1). In this embodiment, yarns (11) and (12) are forwarded by feed rolls (14) and (15) to guide (16) which is located slightly below the bottom of main passageway (2). From guide (16), yarns are fed to the jet (1) either directly into main passageway (2) or through passageway (5). In the air jet, yarns (11) and (12) are entangled into a combined yarn (22) by means of an air stream fed to the air jet through duct (21). The combined yarn (22) from the jet goes through guide (23) which is in line with the bottom of the main passageway (2) and then to feed rolls (25) and (26) which operate at a slower speed than feed rolls (14) and (15) in order to give the desired overfeed. The combined yarn (22) is next fed to a conventional winder (28) in which it is wound into packages of the desired form.

EXAMPLE

The air jet used in the example is that shown in FIGS. 1 and 2 with the angle (A) being 88° and the passageway (5) intercepting passageway (2) at an angle of 45°. The air jet was made of hardened steel and the equipment arrangement for feeding the yarns through the jet was similar to that shown in FIG. 3. Two ends of 150 denier, 34 filament polyester yarn false twist textured were used: one yarn end being "S" twist, and the other end "Z" twist. The two yarns were fed together through the entanglement device at 552 yd./minute with an air pressure of 40 p.s.i.g. and an overfeed of 5.4%. The resulting product was a tightly entangled combined yarn that was successfully used as a warp yarn in a Sulzer loom.

It will be apparent that many modifications and variations can be effected without departing from the scope of the novel concepts of the present invention and the illustrative details disclosed are not to be construed as imposing undue limitations on the invention.

I claim:

1. An air jet device for the production of entangled yarn comprising a block; a main passageway extending therethrough from the upstream side to the downstream side; a second passageway intercepting the bottom of said main passageway at an acute angle and slanting downward therefrom in the upstream direction; and air inlet duct for introducing air into the main passageway, said inlet duct intercepting the bottom of said main passageway with the axis of the main passageway and the axis of the air inlet duct being in substantially the same plane and intersecting at an angle of about 86°-88.5° at a point which is not more than 0.20 inch from the downstream end of the main passageway, the air inlet duct slanting downward from said main passageway in the downstream direction; and a lip adjacent to the bottom of the downstream end of the main passageway and extending in the downstream direction.

2. An apparatus as claimed in claim 1 wherein the distance from the downstream end of the main passageway to the intersection of the axis of the main passageway with the axis of the jet inlet duct is from about 0.14 to 0.19 inch.

3. An apparatus as claimed in claims 1 or 2 wherein said lip extends downstream a distance of about 0.18 to 0.32 inch.

* * * * *